US007086393B1

(12) United States Patent
Moss

(10) Patent No.: US 7,086,393 B1
(45) Date of Patent: Aug. 8, 2006

(54) HYBRID AIRGUN

(76) Inventor: Robert A. Moss, 4641 Cloudcrest Dr., Medford, OR (US) 97504

( * ) Notice: Subject to any disclaimer, the term of this patent is extended or adjusted under 35 U.S.C. 154(b) by 0 days.

(21) Appl. No.: 10/722,173

(22) Filed: Nov. 24, 2003

(51) Int. Cl.
*F41B 11/00* (2006.01)

(52) U.S. Cl. ..... 124/70

(58) Field of Classification Search ..... 124/55, 124/70–77
See application file for complete search history.

(56) References Cited

U.S. PATENT DOCUMENTS

| | | | | | |
|---|---|---|---|---|---|
| 2,119,441 | A * | 5/1938 | Price | 124/69 |
| 2,450,029 | A * | 9/1948 | Wells | 124/69 |
| 4,336,787 | A * | 6/1982 | Cagnoni | 124/69 |
| 4,865,009 | A | 9/1989 | Ford et al. | |
| 5,154,157 | A * | 10/1992 | Goepfert | 124/69 |
| 5,339,791 | A * | 8/1994 | Sullivan | 124/73 |
| 5,341,790 | A * | 8/1994 | Ebert | 124/69 |
| 5,363,834 | A * | 11/1994 | Stuchlik | 124/76 |
| 5,368,007 | A | 11/1994 | Carroll | |
| 5,613,483 | A * | 3/1997 | Lukas et al. | 124/73 |
| 5,669,369 | A * | 9/1997 | Scott | 124/73 |
| 6,089,139 | A | 7/2000 | Russell | |
| 6,581,585 | B1 * | 6/2003 | Nibecker, Jr. | 124/69 |
| 2003/0094167 | A1 | 5/2003 | Nibecker | |

OTHER PUBLICATIONS

Nibecker , Al; "In Search of Power"; Airgun Illustrated vol. 2 No. 5 p. 68 (Sep.-Oct. 2003).
Jue, Tom and Hamilton, Robert; "The Nibecker Quigley Series Air Rifle"; Airgun Illustrated vol. 2 No. 5 p. 78 (Sep.-Oct. 2003).

* cited by examiner

*Primary Examiner*—Teri Pham Luu
*Assistant Examiner*—S. A. Holzen
(74) *Attorney, Agent, or Firm*—Klarquist Sparkman, LLP

(57) ABSTRACT

A hybrid airgun includes a compressed gas chamber; a barrel; a firing valve between chamber and barrel; a secondary cylinder divided into front and back volumes by a secondary piston, the front volume connected to the chamber; a liquefied gas chamber connected to the back volume; a valve for transferring liquefied gas into the liquefied gas chamber; a cocking mechanism; and a firing mechanism. The cocking mechanism fills the compressed gas chamber with a compressed first gas, and/or transfers a liquefied second gas into the liquefied gas chamber. The firing mechanism opens the firing valve. During flow of the first gas into the barrel, pressure exerted by the second gas in the back volume moves the secondary piston and partially disengages it from the secondary cylinder, thereby enabling the second gas to flow into the compressed gas chamber, through the firing valve, and into the barrel.

24 Claims, 5 Drawing Sheets

HYBRID AIRGUN

BACKGROUND

The field of the present invention relates to airguns. A hybrid airgun employing compressed gas and/or liquid gas propellants is disclosed herein.

Airguns for hunting or target shooting operate by a variety of mechanisms, each with its respective advantages and shortcomings. Single-stroke pneumatic airguns are convenient to operate, and exhibit consistent performance, but provide limited muzzle energies. Multi-stroke pneumatic airguns may provide greater muzzle energies, but are difficult and/or tiring to operate, and are less consistent in their performance. Pre-charged pneumatic airguns may provide higher muzzle energies and low recoil, but require access to compressed air tanks and associated support facilities. Carbon dioxide airguns may be conveniently supplied with bottled liquid carbon dioxide, but have relatively low muzzle energies which vary significantly with ambient temperature. Spring piston airguns provide higher muzzle energies, but are difficult to cock, and suffer from large recoil.

SUMMARY

A hybrid airgun comprises: a compressed gas chamber; a barrel; a firing valve controlling gas flow between the compressed gas chamber and the barrel; a secondary cylinder divided into front and back volumes by a secondary piston, the front volume being connected to the compressed gas chamber; a liquefied gas chamber connected to the back volume; a valve for transferring a volume of liquefied gas into the liquefied gas chamber; a cocking mechanism; and a firing mechanism. The cocking mechanism i) fills the compressed gas chamber with a first gas at an elevated pressure, and/or ii) transfers a volume of a liquefied second gas into the liquefied gas chamber through the transfer valve. The firing mechanism opens the firing valve. Compressing a first gas in the compressed gas chamber to an elevated pressure moves the secondary piston so as to reduce the back volume. Pressure exerted by a liquefied second gas transferred into the liquefied gas chamber moves the secondary piston so as to reduce the front volume and further compress the first gas to about the saturation pressure of the second gas. Upon firing of the airgun, the first gas flows through the firing valve into the barrel, and pressure exerted by the second gas in the back volume moves the secondary piston so as to reduce the front volume and maintain pressure of the first gas near the saturation pressure of the second gas during at least an initial portion of the flow of the first gas into the barrel (and movement of the projectile down the barrel). During an intermediate portion of the flow of the first gas into the barrel, pressure exerted by the second gas in the back volume moves the secondary piston so as to at least partially disengage the secondary piston from the secondary cylinder, thereby enabling the second gas to flow into the compressed gas chamber, through the firing valve, and into the barrel.

Objects and advantages pertaining to airguns may become apparent upon referring to the disclosed embodiments as illustrated in the drawings and disclosed in the following written description and/or claims.

Figure 1:
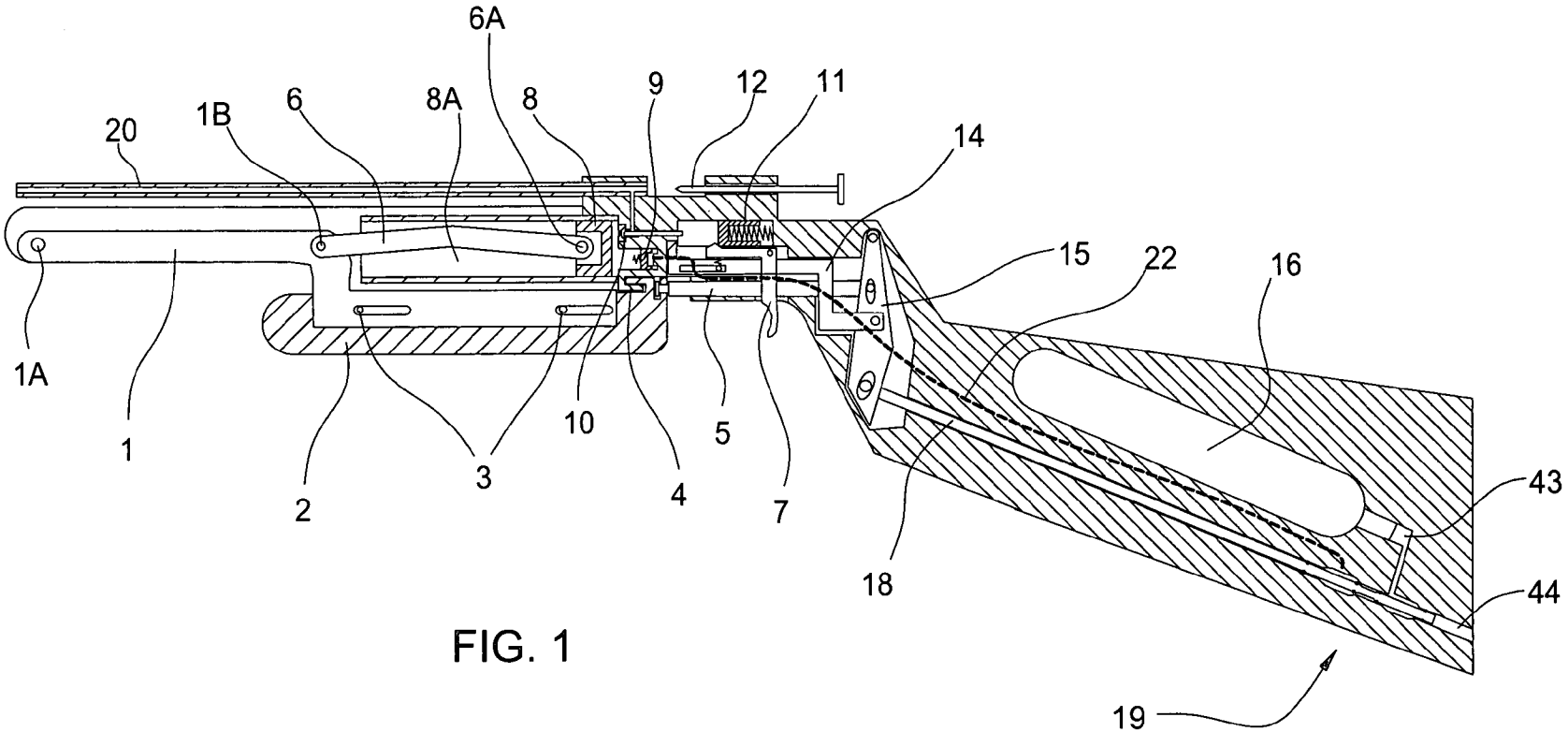
FIG. 1 is a cross-sectional view of a hybrid airgun.
Figure 2:
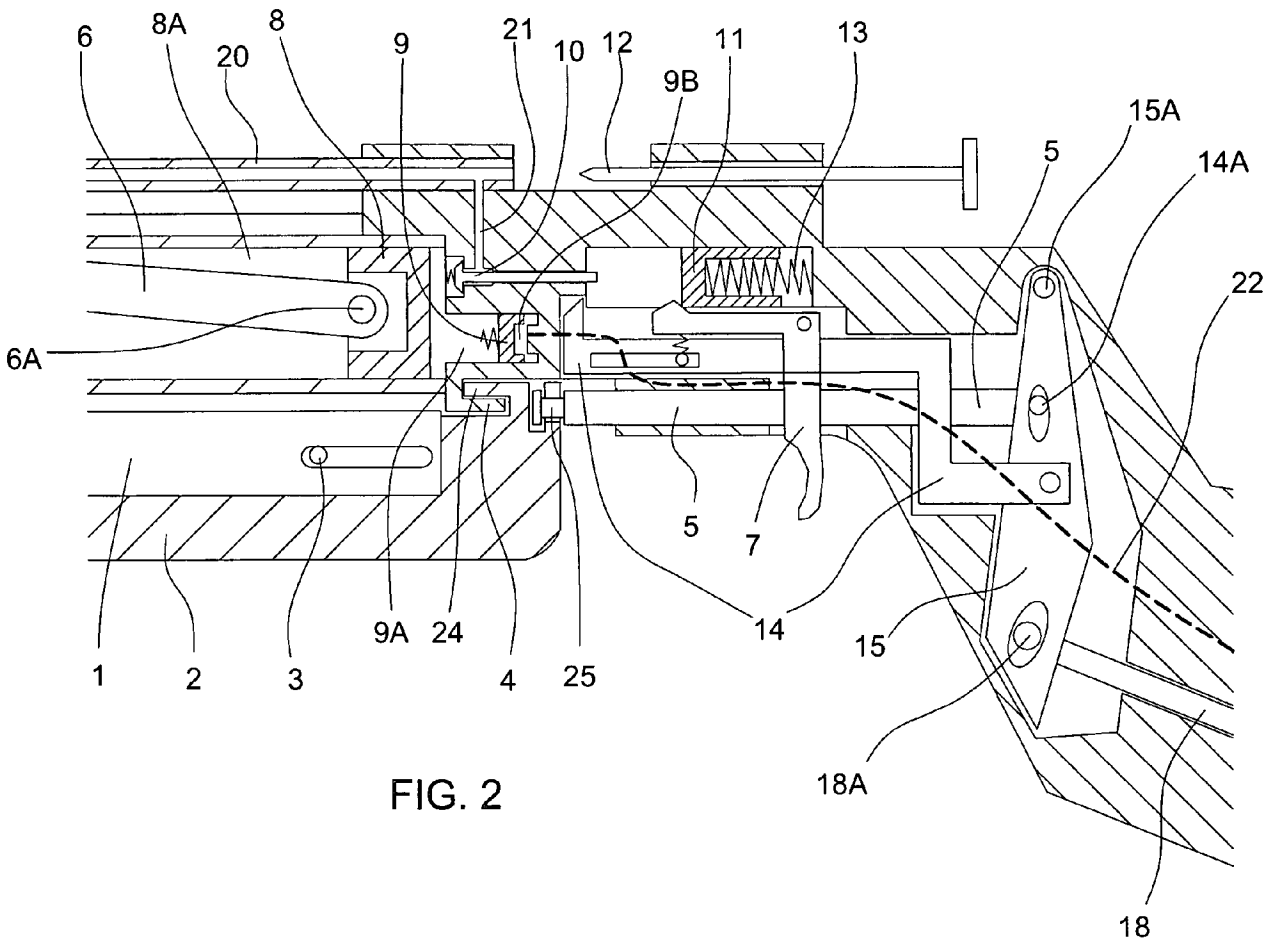
FIG. 2 is a cross sectional view of a portion of a hybrid airgun.
Figure 3:
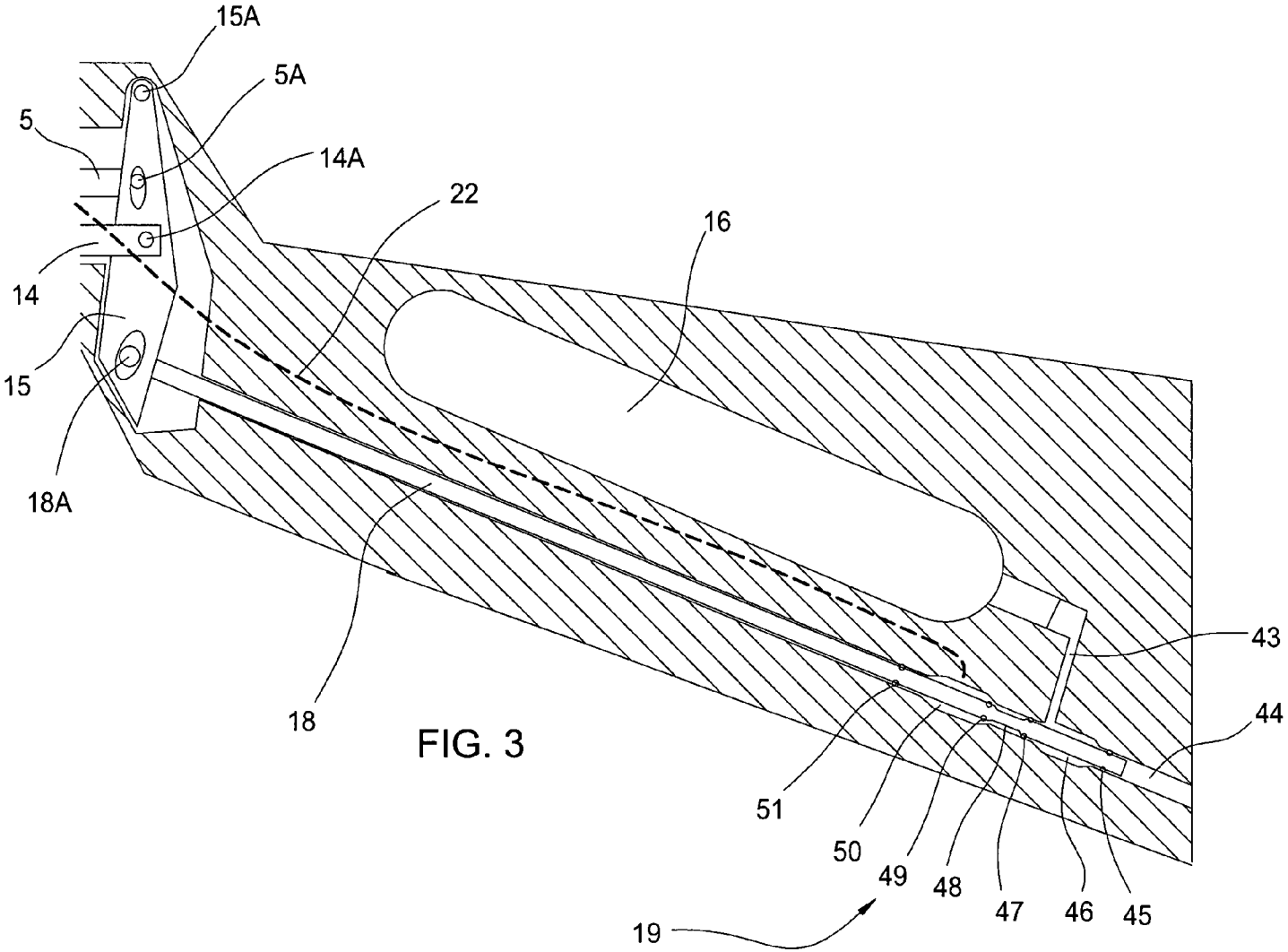
FIG. 3 is a cross sectional view of a portion of a hybrid airgun.
Figure 4:
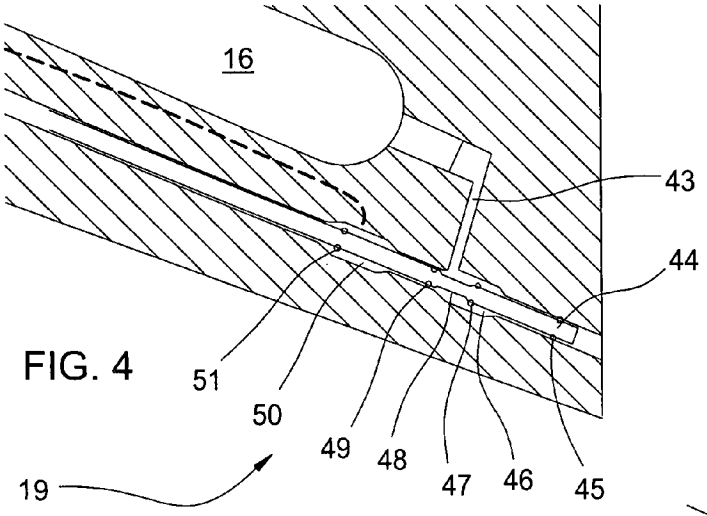
FIG. 4 is a cross sectional view of a portion of a hybrid airgun.
Figure 5:
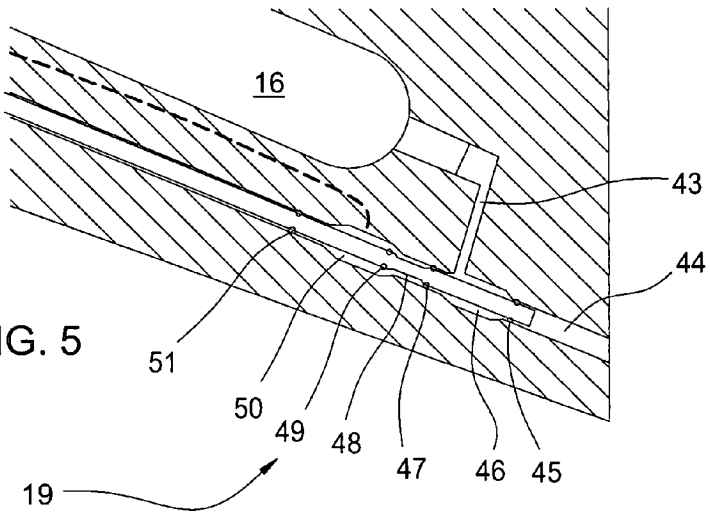
FIG. 5 is a cross sectional view of a portion of a hybrid airgun.

The embodiments shown in the Figures are exemplary, and should not be construed as limiting the scope of the present disclosure and/or appended claims.

DETAILED DESCRIPTION OF EMBODIMENTS

FIGS. 1 through 5 illustrate construction and operation of an exemplary embodiment of a hybrid airgun. A compressed gas chamber, also referred to as a firing chamber, is formed by a primary cylinder 8A and a primary piston 8 that moves within cylinder 8A. Piston 8 is mechanically linked to a first lever 1 by rod 6 via pins 1B and 6A. The first lever 1 is pivotably connected to the airgun at pin 1A. Lever 1, rod 6, and the airgun together form a so-called four-bar mechanism, and form a portion of a cocking mechanism for the exemplary airgun of FIGS. 1–5 ("cocking" generically designating those functions required for preparing the gun to be fired). Pivoting of lever 1 about pin 1A yields reciprocating movement of primary piston 8 within primary cylinder 8A. As lever 1 swings downward and away from the airgun during cocking of the airgun, piston 8 moves so that the volume of the compressed gas chamber increases. At the end of this motion, piston 8 and/or cylinder 8A may be suitably adapted for admitting ambient air to serve as a compressed gas, which is compressed within the compressed gas chamber upon completion of cocking the airgun and prior to firing. Suitable adaptations may include groove(s), chamfer(s), or other structural alteration(s) of the cylinder and/or piston so as to enable partial disengagement of the piston from the cylinder near the end of its outward motion, allowing air to enter the compressed gas chamber.

A secondary cylinder is connected to the compressed gas chamber, and is divided into a front volume 9A and a back volume 9B by a secondary piston 9 (also referred to as an equalization piston). It should be noted that the terms "front" and "back" are functional in nature, and need not be related to the front and back ends of the airgun. The front volume 9A is connected to the compressed gas chamber, while the back volume is connected to a passage 22. When fully engaged with the secondary cylinder, the secondary piston 9 substantially prevents gas flow between the front volume 9A and the back volume 9B. Secondary piston 9 and/or the secondary cylinder within which it moves may be adapted so that as the secondary piston 9 moves to reduce the front volume 9A, at some point the secondary piston 9 becomes at least partially disengaged from the secondary cylinder, allowing gas flow between the front volume 9A and the back volume 9B. A return spring prevents secondary piston 9 from completely leaving the secondary cylinder, and in the absence of sufficient pressure in the back volume fully re-engages the secondary piston 9 within the secondary cylinder. Suitable adaptation(s) of the secondary cylinder and/or secondary piston 9 may include groove(s), chamfer(s), and/or other suitable structural alteration(s) that enable partial disengagement of the piston and cylinder.

In the exemplary embodiment of the hybrid airgun, lever 1 is provided with a sliding handle 2, shown including slider pins 3 sliding within slots in lever 1. The sliding handle 2 includes a tongue 24 for engaging safety latch 4, serving as a safety mechanism to ensure that various cocking actions occur in the proper sequence. Lever 1 cannot be pivoted away from the airgun to cock it until handle 2 slides backwards to disengage the tongue 24 from safety latch 4. Sliding of handle 2 actuates several components of the cocking mechanism necessary for cocking the gun by pushing back on rod 5 (via a groove 25 received within a slot on the sliding handle 2), which is mechanically linked to a second lever 15 (also referred to as a pivot plate, which pivots about pin 15A). Pivot plate 15 is mechanically linked to cocking bar 14 at pin 14A, so that when handle 2 is pulled back to begin cocking the gun, cocking bar 14 is pulled back by pivoting of pivot plate 15. This backward motion of the cocking bar 14 pulls a striker 11 back against a spring 13 until striker 11 is retained against the force of spring 13 by trigger 7. Backward movement of the striker 11 allows a return spring to close firing valve 10, isolating the compressed air chamber from the barrel 20. An alternative mechanism for pulling striker 11 back may include a pin or other mechanical link between bolt 12 and striker 11, so that pulling back the bolt 12 to load the gun also acts to pull back striker 11 and allow firing valve 10 to close (in this instance bolt 12 functions as a portion of the cocking mechanism, and cocking bar 14 may act as a stop to prevent cocking of the airgun prior to pulling back bolt 12). Another alternative mechanism may include a return spring for automatically closed firing valve 10 after firing the airgun. Such a return spring would therefore form a portion of the cocking mechanism (which would require no action on the part of a user).

Pivot plate 15 is also mechanically linked to rod 18 at pin 18A. Rod 18 reciprocates within a passage 44 within the stock of the gun, and is adapted at its lower end to act as a shuttle valve 19 for transferring liquefied gas through passage 22 to the second volume 9B of the secondary cylinder. The shuttle valve 19 comprises a pair of enlarged chambers 46 and 50 of passage 44, four O-ring seals (45/47/49/51) variously engaged between rod 18 and passage 44, and a reduced-diameter segment 48 of rod 18 between the second and third O-ring seals 47 and 49. Enlarged chamber 50 is connected to back volume 9B through passage 22, while enlarged chamber 46 is connected to a liquefied gas reservoir 16 through passage 43. As handle 2 slides backwards and rod 5 causes pivoting of pivot plate 15, rod 18 is pushed downward through passage 44 into a filling position, illustrated in FIG. 4. Enlarged chamber 46 is sealed at each end by O-rings 45 and 49 engaged with passage 44, and a liquefied second gas (liquid carbon dioxide in this example) flows out of reservoir 16, through passage 43 and into chamber 46. In this position enlarged chamber 50, passage 22, and back volume 9B are open to the atmosphere through the upper end of passage 44. When rod 5 is drawn forward again (later in the cocking sequence; described further hereinbelow), a volume of liquefied gas is trapped between O-rings 47 and 49 when O-ring 47 leaves enlarged chamber 46 and engages passage 44. The volume of liquefied gas transferred is defined by passage 44, O-rings 47 and 49, and the reduced diameter segment 48 of rod 44. As rod 44 is drawn further forward, O-ring 51 leaves enlarged chamber 50 engages passage 44, while O-ring 49 enters enlarged chamber 50, disengaging from passage 44. In this position (referred to as the charging position; illustrated in FIG. 5), liquefied gas and/or its vapor may flow through passage 22 into back volume 9B. Engaged O-ring 51 isolates the enlarged chamber 50 (also referred to as a liquefied gas chamber) from the atmosphere, while engaged O-ring 47 isolates the liquefied gas chamber from the liquefied gas reservoir 16.

Once the handle 2 is pulled back and tongue 24 is disengaged from safety latch 4, firing valve 10 is closed and liquefied gas fills chamber 46 through the action of rod 5 and pivot plate 15. At this point a first gas (ambient air in this example) may be drawn into the compressed gas chamber and then compressed to an elevated pressure. Air is drawn into the cylinder 8A (through the secondary cylinder around the partially disengaged secondary piston 9) as the lever 1 is pivoted downward and away from the airgun. If the primary cylinder and primary piston are suitably adapted (as described hereinabove), air may enter the compressed gas chamber when the primary piston 8 partially disengages from the primary cylinder 8A. The air (or other first gas) is then compressed to an elevated pressure within the compressed gas chamber as the lever 1 swings back up toward the airgun and the primary piston moves within the primary cylinder to reduce the volume of the compressed gas chamber. The compressed gas is substantially confined within the compressed gas chamber by the closed firing valve 10, and by re-engagement of the secondary piston 9 within the secondary cylinder (as described hereinabove). As the first gas is compressed within the compressed gas chamber, the elevated pressure causes the secondary piston 9 to move within the secondary cylinder to maximize the front volume 9A. Residual air and/or gas(es) in the back volume 9B are vented through passage 22, chamber 50, and the upper portion of passage 44 (as in FIG. 4). As the lever 1 pivots back up toward the airgun, the four-bar mechanism undergoes an inversion that forces the lever 1 into its starting position.

Once the lever 1 is pulled back up to the airgun, thereby maximally compressing the first gas in the compressed air chamber, the slot in the handle 2 re-engages the groove 25 of rod 5. The sliding handle 2 slides forward, re-engaging tongue 24 and safety latch 4, and pulling rod 5 forward to its original position. Re-engagement of tongue 24 and safety latch 4 ensures that the four-bar mechanism cannot accidentally release from the inversion and violently spring apart (the so-called "bear trap effect"). This safety mechanism is even more important later when the liquefied gas chamber 50 is filled with the second gas, further increasing the pressure within the compressed gas chamber. Forward movement of rod 5 in turn causes forward movement of pivot plate 15, pulling the cocking bar 14 forward and pulling rod 18 up through passage 44. Forward movement of cocking bar 14 removes it as an obstacle to forward motion of the striker 11 when released by the trigger 7, so that the airgun is ready for firing.

Movement of rod 18 up through passage 44 to the charging position (FIG. 5) transfers a volume of liquefied second gas into the chamber 50, through passage 22, and into back volume 9B of the secondary cylinder (as described hereinabove). A portion of the liquefied second gas changes to vapor at the saturation pressure, which typically exceeds the elevated pressure of the compressed gas chamber. As a result, pressure exerted by the second gas in the back volume 9B moves the secondary piston 9 so as to reduce the front volume 9A and further compress the first gas to about the saturation pressure of the second gas. The range of movement of the secondary piston 9, the amount of the liquefied second gas converted to vapor, and the final pressure achieved in the compressed gas chamber depend on the identity of the second gas and the operating temperature of the airgun (discussed further hereinbelow).

At this point the airgun is fully charged and ready for loading and firing. A pellet is inserted into the breach at the rear of the barrel 20, and bolt 12 is closed and locked into place. A push rod at the end of bolt 12 pushes the pellet past passage 21, which connects the barrel 20 and the compressed gas chamber. To fire the airgun, trigger 7 is pulled, releasing striker 11 to move forward under the impetus of spring 13. Striker 11 hits the stem of firing valve 10, breaking its seal and pushing it forward against its return spring. Spring 13 holds the firing valve 10 open against the force exerted by the weaker return spring. The compressed first gas in the compressed gas chamber is now free to flow through the firing valve and passage 21 and into barrel 20. The flow of compressed first gas into the barrel accelerates the pellet forward through the barrel. During an initial portion of the flow of the first gas into the barrel 20 from the compressed gas chamber, pressure exerted by the second gas in the back volume 9B moves the secondary piston 9 so as to reduce the front volume 9A and maintain pressure of the first gas near the saturation pressure of the second gas during an initial portion of the flow of the first gas into the barrel 20. How close to the second gas saturation pressure the compressed gas chamber remains depends on a variety of variables, such as the mass of and friction on the secondary piston 9 and the stiffness of its return spring, and the flow resistances of the passages 21 and 22.

At an intermediate point in the flow of the first gas through the firing valve 10 into the barrel 20, the secondary piston 9 moves to reduce the front volume 9A and reaches a position where it becomes partially disengaged from the secondary cylinder. Any remaining liquefied second gas promptly vaporizes, and the second gas flows past piston 9 from the back volume 9B into the front volume 9A, into the compressed gas chamber, through passage 21 and the firing valve 10, and into barrel 20, mixing with the first gas. The flow of the second gas into the barrel 20 increases the acceleration of the pellet over the acceleration that would be obtained from expansion of the first gas alone.

After firing, when the flows of first and second gases have ceased and all pressures have returned to near atmospheric pressure, the return spring re-engages secondary piston 9 within the secondary cylinder, separating the front volume 9A from the back volume 9B. Elevated pressure within the compressed gas chamber from the next cocking sequence forces the secondary piston through the secondary cylinder to minimize the back volume 9B, with residual gases vented through passage 22, chamber 50, and passage 44 (as described earlier). The firing valve 10 will not close until the cocking bar 14 pulls back the striker 13 when the handle 2 is pulled back for the next cocking sequence. In this way, the cocking mechanism ensures unless firing valve 10 is closed, the first gas cannot be compressed within the compressed gas chamber, and the liquefied second gas is not charged into chamber 50 or back volume 9B.

For optimal operation of the airgun, the secondary piston 9 must respond quickly to any pressure differential between front volume 9A and back volume 9B. The entire flow of the first and second gases through the firing valve typically occurs in about 5 msec or less. The mass of secondary piston 9 should be as small as practicable, while resistance to movement or tendency to bind within the secondary cylinder should be as small as practicable. Lengthening the secondary piston reduces its tendency to bind, while the mass may be reduced by hollowing out the back end of the piston and using a suitable lightweight material (aluminum for example; other material may be employed). The overall volume of the back volume 9B should be as small as practicable, to reduce the volume of liquefied gas consumed per shot. If the backside of secondary piston 9 is hollowed out to reduce its mass, the secondary cylinder may be provided with a corresponding protrusion which "fills in" the hollowed out backside of the piston when the back volume 9B is at its minimum. Many sizes, masses, materials, and/or configurations for piston 9 may be employed while remaining within the scope of the present disclosure and/or appended claims. A suitable adaptation for enabling partial disengagement of the secondary piston 9 from the secondary cylinder may comprise a slightly widened end portion of front volume 9A, and one or more longitudinal groove(s) along secondary piston 9 behind an O-ring seal. Piston 9 becomes partly disengaged from the secondary cylinder when the O-ring seal reaches the widened portion of the front volume 9A, and the second gas flows along the longitudinal groove(s) and past the O-ring seal and into the front volume. After gas flow has ended, the return spring re-engages the O-ring seal with the narrower portion of the secondary cylinder. Many other adaptations of piston 9 and/or the secondary cylinder may be employed for providing partial disengagement and flow of gas from the back volume to the front volume while remaining within the scope of the present disclosure and/or appended claims.

The particular mechanical arrangements shown for the four bar mechanism, the trigger 7, sliding handle 2, rod 5, pivot plate 15, the cocking bar 14, striker 13, firing valve 10, shuttle valve 19, liquefied gas reservoir 16, and so forth are exemplary, and should not be construed as limiting the scope of the present disclosure or the appended claims. It is well known that there exist myriad equivalents, variants, and/or alternatives to these particular structures and mechanisms, and any suitable combination of such equivalents, variants, and/or alternatives shall fall within the scope of the present disclosure and/or appended claims. In particular, a phrase such as "cocking mechanism", "safety mechanism", or "firing mechanism" may not always indicate a single component or a group of coupled components, but shall also encompass a group of independently actuated components for achieving the necessary functions for cocking and/or firing the airgun.

The primary piston 8 and cylinder 8A, along with the four-bar mechanism, may be arranged to yield compression of ambient air to between about 400 psig and about 600 psig with a single stroke, typically around 500 psig. Pressures outside this range may be used as well, however, lower pressures tend to yield lower muzzle energies, while higher pressures may be physically demanding for a user to achieve. Any 9 suitable gas may be employed as the first gas compressed within the compressed gas chamber, and ambient air may be the most conveniently available first gas. Other mechanisms for compressing the first gas, or sources of the compressed first gas, shall fall within the scope of the present disclosure and/or appended claims. While mechanical compression of the first gas by primary piston 8 within cylinder 8A has been disclosed for providing the first gas at an elevated pressure, other methods or devices may be employed for this purpose while remaining within the scope of the present disclosure and/or appended claims. An external source of compressed gas may be employed, for example, for charging the compressed gas chamber to an elevated pressure during the cocking sequence, prior to charging the back volume with liquefied second gas.

A typical liquefied second gas is liquid carbon dioxide. Any other suitable liquefied second gas may be employed as well. An 88 gram reservoir of liquid carbon dioxide is readily available commercially, for example, and is of a physical size consistent with storage of the reservoir within the stock of the airgun. The stock and/or butt of the airgun may be adapted in any suitable way for facilitating storage of the liquefied gas and/or changing/refilling of the reservoir. While such self-contained storage of the liquefied second gas is not strictly necessary, it is more convenient than the need for an external gas supply characteristic of many previous pre-charged pneumatic airguns. Other suitable sources of liquefied gas may be equivalently employed. The saturation pressure of liquid carbon dioxide (and most other liquefied gases) varies strongly with temperature, ranging from about 600 psi at about 45° F. to about 1000 psi at about 85° F. The hybrid operation of the airgun of FIGS. 1 through 5 typically produces higher muzzle energies than simple adiabatic expansion of either the compressed air or the carbon dioxide alone, and in addition may be optimized to at least partially compensate for the saturation pressure variation to reduce the temperature variation of the airgun muzzle energy. A hybrid airgun as disclosed herein may produce muzzle energies that remain between about 12 ft-lb and about 14 ft-lb over a temperature range between about 45° F. and about 85° F. These muzzle energies are equivalent to muzzle velocities between about 820 ft/sec and about 890 ft/sec for an 8 grain pellet. The muzzle velocity range varies accordingly with the mass of the pellet.

Figure 6:
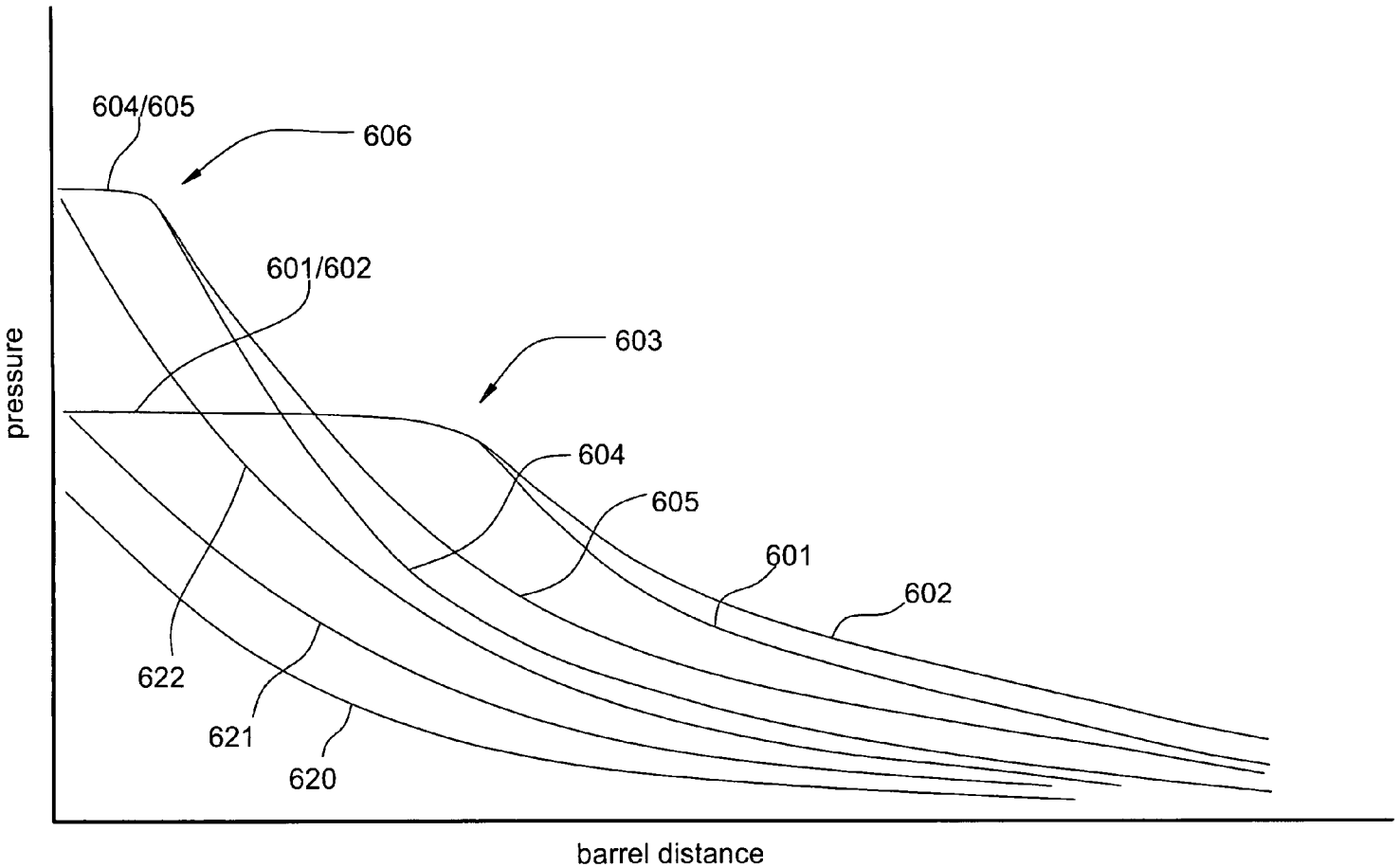
FIG. 6 illustrates schematically variation of gas pressure with barrel distance.

FIG. 6 illustrates schematically this compensation mechanism. At lower temperatures, corresponding to the curves 601 and 602, the saturation pressure of carbon dioxide (or other liquefied second gas) is relatively low. There is only a small increase in pressure in the compressed gas chamber, relatively little vaporization of liquefied carbon dioxide, and relatively little motion of secondary piston 9 within the secondary cylinder. Upon firing, the initial portion of gas flow through the firing valve 10, comprising the compressed first gas only flowing at a nearly constant pressure near the second gas saturation pressure, lasts for a relatively long distance of movement of the pellet through the barrel, up to about the region 603. Near the region 603, the secondary piston 9 partially disengages from the secondary cylinder, the remaining liquid carbon dioxide vaporizes, and the carbon dioxide begins to flow into the compressed gas chamber and mix and expand with the compressed air (or other first gas). Curve 601 represents schematically the further substantially adiabatic expansion of the compressed air only, while curve 602 represents schematically mixing and further expansion of the mixture of air and carbon dioxide. The area under these curves is proportional to the work done on the pellet as it is propelled down the barrel (i.e., the muzzle energy, which in turn with the pellet mass determines the muzzle velocity of the pellet). It is easily seen that the release of the carbon dioxide into the compressed air increases the energy transferred to the pellet, and that both curves 601 and 602 represent significantly larger muzzle energies than adiabatic expansion of the compressed air alone (curve 620) or of the carbon dioxide alone (curve 621).

At higher temperatures, corresponding to curves 604 and 605, the saturation pressure of carbon dioxide may be much higher. There is a relatively larger increase in pressure within the compressed gas chamber, a relatively large amount of vaporization of liquid carbon dioxide, and relatively larger movement of secondary piston 9 within the secondary cylinder. Upon firing, the initial portion of gas flow through the firing valve 10, comprising the compressed first gas only flowing at a nearly constant pressure near the second gas saturation pressure, lasts for a relatively short distance of movement of the pellet through the barrel, up to about the region 606. Near the region 606, the secondary piston 9 partially disengages from the secondary cylinder, the (relatively little) remaining liquid carbon dioxide vaporizes, and the carbon dioxide begins to flow into the compressed gas chamber and mix with the compressed air. Curve 604 represents schematically the further substantially adiabatic expansion of the compressed air only, while curve 605 represents schematically mixing and further expansion of the mixture of air and carbon dioxide. It is easily seen that both curves 604 and 605 represent significantly larger muzzle energies than adiabatic expansion of the compressed air alone (curve 620) or of the carbon dioxide alone (curve 622).

It may also be seen from the curves of FIG. 6 that hybrid operation may be employed for reducing variation of muzzle energy over a specified temperature range. The high initial pressure and relatively rapid pressure drop characteristic of curve 605 may yield an area under the curve (i.e., the amount of energy imparted to the pellet) that may be nearly equal to the corresponding area under curve 602, which starts at a lower pressure but maintains that pressure over a longer barrel distance and ends at a higher pressure than curve 605. Many variables may be optimized against one another for maintaining similar areas under the curves, thereby achieving a desired reduction of the temperature variation of the muzzle energy. Crude equilibrium thermodynamic models may be employed for estimating parameters, but exact calculations are difficult due to the dynamic nature of the expansion and mixing, and due to the nearness of phase transitions and/or critical points of one or more gases involved. It may prove that systematic experimentation is the most efficient route toward finding optimized sets of operating parameters. Parameters to be optimized include (but are not necessarily limited to): identity of first and second gases; volume and pressure of compressed first gas; volume of liquefied second gas transferred; volume of the secondary cylinder 9*a*; mass and friction of the secondary piston 9; flow resistance through passages 21 and 22, firing valve 10, and around secondary piston 9; diameter and length of barrel 20; and so forth. It may well be the case that multiple different sets of operating parameters may yield similar muzzle energy performance characteristics, and/or that different sets of operating parameters may be preferred depending on the operating conditions and performance objectives. Such optimizations of hybrid airgun performance shall fall within the scope of the present disclosure and/or appended claims.

Exemplary parameters for a hybrid airgun are:

- first gas is ambient air compressed to about 500 psig, with the primary piston and primary cylinder being about 1 inch in diameter and yielding a compressed gas chamber about 1.8 milliliters in volume (upon compression);
- second gas is liquefied carbon dioxide, with the shuttle valve transferring about 0.6 milliliters of liquefied gas;
- the secondary cylinder is about 0.75 in long with a diameter of about 0.45 in;
- the secondary piston is about ¼ in long with a diameter of about 0.45 in, is constructed from aluminum, and is bored on its back side to reduce its mass to about 1.5 g;
- passage 21, the passage through firing valve 10, and the groove along the secondary piston all have a diameter of about ⅛ in, and passage 21 is about ¼ in long; and
- the barrel is about 20 in long with a diameter of about 0.18 in.

The airgun may be fired using only compressed gas, if no liquefied gas is transferred into the liquefied gas chamber before firing the airgun. This may be achieved by removing pin 18A, thereby decoupling the shuttle valve 19 from the pivot plate 15. Alternatively, passage 43 may be closed with a suitable valve, or the liquefied gas reservoir 16 may be disconnected or removed. Lever 1 is pivoted to compress the first gas (ambient air, for example) within primary cylinder 8A. Muzzle energy is reduced relative to hybrid use (i.e., both compressed first gas and liquefied second gas); accordingly, such use may be best suited to short distance shooting.

The airgun may be fired using only liquefied gas, if no gas is compressed in the compressed gas chamber before firing the airgun. This may be achieved by sliding the handle 2 backward and then forward to charge the back volume 9B with liquefied gas, without pivoting the lever 1 to compress gas within the primary cylinder. With no elevated pressure in the compressed gas chamber, secondary piston 9 immediately moves until it partially disengages from the secondary cylinder, and the second gas vaporizes and pressurizes the compressed gas chamber to an elevated pressure (typically somewhat less than the second gas saturation pressure, since typically all of the liquefied gas vaporizes under these operating conditions). Muzzle energy is reduced relative to hybrid use (i.e., both compressed first gas and liquefied second gas); accordingly, such use may be best suited to short distance shooting. Muzzle energy varies with temperature due to the temperature variation of the elevated pressure of the second gas; accordingly, such use may be best suited for indoor shooting. An 88 gram liquid carbon dioxide reservoir (readily available commercially and of a convenient physical size) may provide hundreds of shots under such use conditions. Other liquefied gas sources may be equivalently employed.

It is intended that equivalents of the disclosed exemplary embodiments and methods shall fall within the scope of the present disclosure. It is intended that the disclosed exemplary embodiments and methods, and equivalents thereof, may be modified while remaining within the scope of the present disclosure.

What is claimed is:

1. An airgun, comprising:

a compressed gas chamber for receiving substantially ambient air;

a barrel;

a firing valve controlling gas flow between the compressed gas chamber and the barrel;

a cylinder connected to the compressed gas chamber;

a piston reciprocating within the cylinder and dividing the cylinder into a front volume connected to the compressed gas chamber and a back volume;

a fluid chamber connected to the back volume of the cylinder;

a transfer valve for transferring a volume of substantially carbon dioxide fluid from a fluid source into the fluid chamber;

a cocking and firing mechanism capable of selectively opening and closing the firing valve to allow pressurized gas in the compressed gas chamber to be released and directed through the barrel, the mechanism also controlling the transfer valve to selectively transfer fluid from the fluid source to the fluid chamber.

2. The airgun of claim 1, wherein the piston is movable in response to pressure in the back volume to at least partially disengage from the cylinder and to establish a fluid flow path between the back volume and the compressed gas chamber.

3. The airgun of claim 1, wherein:

the compressed gas chamber and the front volume of the cylinder are in fluid communication with each other.

4. The airgun of claim 1, wherein:

wherein the piston is movable in response to pressure exerted by the substantially carbon dioxide fluid in the back volume to at least partially disengage the piston from the cylinder, thereby enabling the substantially carbon dioxide fluid to flow into the compressed gas chamber.

5. The airgun of claim 1, wherein the compressed gas chamber comprises a primary cylinder and a corresponding primary piston, and the cocking and firing mechanism moves the primary piston within the primary cylinder so as to compress the substantially ambient air to an elevated pressure within the compressed gas chamber.

6. The airgun of claim 5, wherein the cocking and firing mechanism includes:

a lever pivotably connected to the airgun; and a mechanical linkage connecting the lever and the primary piston, wherein pivoting of the lever results in movement of the primary piston within the primary cylinder.

7. The airgun of claim 5, wherein a single stroke of the primary piston within the primary cylinder compresses the substantially ambient air to between about 400 psig and about 600 psig.

8. The airgun of claim 1, further comprising a fluid reservoir, wherein the fluid reservoir is connected to the fluid chamber through the transfer valve.

9. The airgun of claim 1, further comprising a safety mechanism, wherein:

the safety mechanism must be disengaged for enabling cocking of the airgun; and the safety mechanism must be re-engaged for enabling firing of the airgun.

10. The airgun of claim 9, wherein disengaging the safety mechanism closes the firing valve.

11. The airgun of claim 9, wherein the safety mechanism must be disengaged to enable filling of the compressed gas chamber with substantially ambient air at an elevated pressure.

12. The airgun of claim 9, wherein re-engaging the safety mechanism transfers the volume of fluid into the fluid chamber.

13. The airgun of claim 9, wherein the safety mechanism must be re-engaged to enable opening of the firing valve.

14. The airgun of claim 1, wherein the cocking and firing mechanism includes a lever pivotably connected to the airgun, and a mechanical linkage connected to the lever for closing the firing valve.

15. The airgun of claim 1, wherein the cocking and firing mechanism includes a lever pivotably connected to the airgun, and a mechanical linkage connected to the lever for actuating the transfer valve.

16. The airgun of claim 1, wherein the transfer valve comprises a shuttle valve.

17. The airgun of claim 1, further comprising a passage for enabling gas to vent from the back volume during filling of the compressed gas chamber with the substantially ambient air and prior to transferring the volume of the substantially carbon dioxide fluid into the fluid chamber.

18. The airgun of claim 1, wherein:

the cocking and firing mechanism is actuatable to fill the compressed gas chamber with substantially ambient air at an elevated pressure, and to cause the transfer valve to initiate transfer of the substantially carbon dioxide fluid into the fluid chamber.

19. The airgun of claim 1, wherein:

the compressed gas chamber comprises the substantially ambient air at an initial pressure of between about 400 psig and about 600 psig;

the back volume comprises the substantially carbon dioxide fluid that exerts a pressure on the piston causing the substantially ambient air in the compressed gas chamber to be compressed to a higher pressure in a range of about 700 psig to about 900 psig; and a resulting airgun muzzle velocity of a projectile fired through the barrel by the air and the fluid expelled through the barrel is between about 750 ft/s and about 850 ft/s over a temperature range between about 45° F. and about 85° F.

20. The airgun of claim 1, wherein:

the airgun further comprises a fluid reservoir connected to the fluid chamber through the transfer valve;

the transfer valve comprises a shuttle valve;

the compressed gas chamber comprises a primary cylinder and a corresponding primary piston;

the cocking and firing mechanism includes a first lever pivotably connected to the airgun and a mechanical linkage connecting the lever and the primary piston, and pivoting of the lever results in movement of the primary piston within the primary cylinder, so that cocking of the airgun by pivoting the first lever results in movement of the primary piston within the primary cylinder so as to compress the substantially ambient air within the compressed gas chamber;

the first lever includes a safety latch, wherein the safety latch must be disengaged for enabling pivoting of the first lever and cocking of the gun;

the cocking and firing mechanism includes a second lever pivotably connected to the airgun and mechanically linked to the safety latch so that disengaging and re-engaging the safety latch result in pivoting movement of the second lever;

the second lever is mechanically linked to the firing valve so that disengaging the safety latch closes the firing valve;

the second lever is mechanically linked to the firing valve so that the safety latch must be re-engaged to enable opening of the firing valve;

the second lever is mechanically linked to shuttle valve, so that disengaging the safety latch transfers the volume of the substantially carbon dioxide fluid from the fluid reservoir and re-engaging the safety latch transfers the volume of the substantially carbon dioxide fluid into the fluid chamber; and the airgun further comprises a passage for enabling gas to vent from the back volume during compression of the substantially ambient air in the compressed gas chamber and prior to transferring the volume of the substantially carbon dioxide fluid into the fluid chamber.

21. The airgun of claim 1, wherein the piston is movable in response to pressure in a direction causing the front volume to reduce in volume when a pressure in the back volume exceeds a pressure in the front volume.

22. The airgun of claim 1, wherein the front volume comprises compressed substantially ambient air at a first pressure, and the piston is movable in response to pressure exerted by the substantially carbon dioxide fluid in the back volume to cause the front volume to reduce in volume, thereby compressing the compressed substantially ambient air in the front volume to a second pressure higher than the first pressure.

23. The airgun of claim 22, wherein the piston is movable in response to pressure exerted by the substantially carbon dioxide fluid to compress a remaining portion of the compressed substantially ambient air in the front volume after the compressed substantially ambient air has begun to flow through the barrel when the firing valve is opened.

24. The airgun of claim 1, wherein over a temperature range between about 45° F. and about 85° F., the pressure exerted by the substantially carbon dioxide fluid in the back volume on the piston maintains the substantially ambient air in the compressed gas chamber at a substantially constant pressure for at least an interval following opening of the firing valve, thereby maintaining a repeatable muzzle energy that varies less than about 10%.

* * * * *